US006033622A

United States Patent [19]

Maruyama

[11] Patent Number: 6,033,622

[45] Date of Patent: Mar. 7, 2000

[54] METHOD FOR MAKING METAL MATRIX COMPOSITES

[75] Inventor: Benji Maruyama, Yellow Springs, Ohio

[73] Assignee: The United States of America as represented by the Secretary of the Air Force, Washington, D.C.

[21] Appl. No.: 09/160,207

[22] Filed: Sep. 21, 1998

[51] Int. Cl.[7] ..... B22F 1/02

[52] U.S. Cl. ..... 419/35; 427/217; 427/585

[58] Field of Search ..... 419/35, 6; 75/245, 75/249; 428/570, 546; 427/585, 212, 217

[56] References Cited

U.S. PATENT DOCUMENTS

| | | |
|---|---|---|
| 3,501,333 | 3/1970 | Groves et al. . |
| 3,533,824 | 10/1970 | Terrill et al. . |
| 3,781,170 | 12/1973 | Nakao et al. . |
| 4,053,011 | 10/1977 | Riewald et al. . |
| 4,115,213 | 9/1978 | Ogisu et al. . |
| 4,499,156 | 2/1985 | Smith et al. . |
| 4,544,610 | 10/1985 | Okamoto . |
| 4,565,744 | 1/1986 | Walter et al. . |
| 4,623,388 | 11/1986 | Jatkar et al. . |
| 4,722,751 | 2/1988 | Akechi et al. . |
| 4,746,374 | 5/1988 | Froes et al. . |
| 4,756,753 | 7/1988 | Miura . |
| 4,818,567 | 4/1989 | Kemp, Jr. et al. . |
| 4,818,633 | 4/1989 | Dinwoodie et al. . |
| 4,946,500 | 8/1990 | Zedalis et al. . |
| 4,954,235 | 9/1990 | Takeshima et al. . |
| 5,020,584 | 6/1991 | Aghajanian et al. . |
| 5,028,392 | 7/1991 | Lloyd et al. . |
| 5,130,459 | 7/1992 | Shinzawa . |
| 5,173,327 | 12/1992 | Sandhu et al. . |
| 5,336,378 | 8/1994 | Nishimura et al. . |
| 5,372,681 | 12/1994 | Iacovangelo et al. . |
| 5,379,718 | 1/1995 | Onishi . |
| 5,506,061 | 4/1996 | Kindl et al. . |
| 5,603,815 | 2/1997 | Lashmore et al. . |
| 5,698,081 | 12/1997 | Lashmore et al. . |

OTHER PUBLICATIONS

H. Lehmkuhl, K. Mehler and U. Landau, "The Principles and Techniques of Electrolytic Aluminum Deposition and Dissolution in Organoaluminum Electrolytes" in: H. Gerischer and C.W. Tobias, ed., *Advances in Electrochemical Science and Engineering*, vol. 3, (New York, VCH, 1990), pp. 163–226, QD552.A28.

Annual Report Electrodeposition Group, National Institute of Standards and Technology, D. Lashmore, Ed., published last quarter 1990.

D.A. Javernick et al., Titanium Preconditioning of Al203 for Liquid–State Processing of Al–Al203 Composite Materials, Metallurgical and Materials Transactions A, vol. 29A, Jan. 1998, pp. 327–337.

C. Chen, et al., Titanium Deposition on the Alumina Particles by Using CVD–FBR Technology, AlChE Symp. Ser. (1996), No. 313, (Progress in Fluidization and Fluid Particle System), vol. 92. pp. 96–99.

A. Umezawa et al., SiC Coating with Ti Using Plasma CVD Asisted with Laser, Surf. Modif. Technol. X, Proc. Int. Conf., 10th (1997), pp. 385–395.

*Primary Examiner*—Ngoclan Mai

*Attorney, Agent, or Firm*—Charles E. Bricker; Thomas L. Kundert

[57] ABSTRACT

Novel processes for fabricating metal matrix composites consisting of discontinuous reinforcing particles in a metal matrix are described. In one aspect, reinforcing particles are coated with a metal matrix material by means of chemical vapor deposition using a volatile metal-containing compound, followed by consolidation of the metal-coated particles. In another aspect, reinforcing particles are coated with a metal matrix material by means of electrochemical deposition of a metal, followed by consolidation of the metal-coated particles. In yet another aspect, reinforcing particles coated with a metal matrix material by one of the aforesaid methods are blended with metal or alloy particles not containing such reinforcement, then consolidated.

12 Claims, No Drawings

METHOD FOR MAKING METAL MATRIX COMPOSITES

RIGHTS OF THE GOVERNMENT

The invention described herein may be manufactured and used by or for the Government of the United States for all governmental purposes without the payment of any royalty.

BACKGROUND OF THE INVENTION

The present invention relates to a composite material comprising a metal matrix reinforced with particles of a reinforcing material and a process for manufacturing such a composite material.

Composites comprising metal alloys reinforced with hard particles such a silicon carbide are known in the art. Composites comprising aluminum alloys reinforced with hard particles are particularly well known in the art. The latter have been used in a wide variety of applications including pistons for automotive engines and drive shafts. Aluminum metal and alloys reinforced with a particulate such as silicon carbide, aluminum oxide or aluminum nitride is a particularly attractive material because of highly attractive properties such as higher elastic modulus than aluminum, a density similar to aluminum, good thermal conductivity, low thermal expansion and good tensile properties.

Commercial efforts to make a reinforced aluminum material have included liquid metal processes and powder metallurgy processes. The liquid metal processes, such as stirring particulate into molten aluminum and casting a shape, suffer from several disadvantages. The volume fraction of particulate is generally limited to less than about 30 percent in this type process because the mixture becomes too viscous to mix. The reaction between many liquid aluminum alloys and silicon carbide reinforcement materials can result in the formation of aluminum carbide, which tends to degrade composite properties.

Powder metallurgy processes offer a way of making much higher volume fraction composites, up to about 70 percent particulates, and avoid the problem of chemical reactivity. In the simplest such process, a metal alloy powder and a particulate powder are mixed, then consolidated by compacting at an elevated temperature. This process has the primary disadvantage of inhomogeneous particulate distribution. Powder metallurgy processes may also have problems such as oxidation of the metal alloy powder, residual gas entrapment, and the low green strength or as-compacted strength of higher volume fraction particulates.

An alternative to simple blending of metal alloy powder and particulate powder comprises mechanical alloying wherein the matrix metal material and reinforcing particles are subjected to energetic mechanical milling. The milling causes the metallic matrix material to enfold around each of the reinforcing particles while the charge being subjected to energetic milling is maintained in a powdery state. This type of milling provides a strong bond between the matrix material and the surface of the reinforcing particle. After the milling is completed, the resulting powder is consolidated or compacted and subjected to working such as rolling, sinter forging, cold isostatic pressing and hot forging, hot pressing or cold isostatic pressing and hot extrusion. Aside from the relatively high cost of milling, this method also has the disadvantage of inhomogeneous particulate distribution.

What are desired are processes for fabricating metal matrix composites consisting of discontinuous reinforcing particles in a metal matrix which overcome these disadvantages.

Accordingly, it is an object of the present invention to provide novel processes for fabricating metal matrix composites consisting of discontinuous reinforcing particles in a metal matrix.

Other objects and advantages of the present invention will be apparent to those skilled in the art.

SUMMARY OF THE INVENTION

In accordance with the present invention there are provided novel processes for fabricating metal matrix composites consisting of discontinuous reinforcing particles in a metal matrix. In accordance with one aspect of the invention, reinforcing particles are coated with a metal matrix material by means of chemical vapor deposition using a volatile metal-containing compound, followed by consolidation of the metal-coated particles. In accordance with another aspect of the invention, reinforcing particles are coated with a metal matrix material by means of electrochemical deposition of a metal, followed by consolidation of the metal-coated particles. In yet another aspect of the invention, reinforcing particles coated with a metal matrix material by one of the aforesaid methods are blended with metal or alloy particles not containing such reinforcement, then consolidated.

DETAILED DESCRIPTION OF THE INVENTION

The present invention contemplates processes for producing a metal matrix composite material consisting of reinforcing particles in a metal matrix. Such reinforcing particles include both particulates and fibers or whiskers of carbon, graphite, silicon carbide, aluminum oxide, zirconia, garnet, aluminum silicates including those silicates modified with fluoride and hydroxide ions (e.g., topaz), boron carbide, simple or mixed carbides, borides, carboborides and carbonitrides of tantalum, tungsten, zirconium, hafnium and titanium, and intermetallics such as $Ni_3Al$. Because of the non-abrasive nature of the process of this invention, it is possible to use softer reinforcing or lubricious particles such as graphite and carbon than are generally considered for use in reinforcing metal matrices. The size of particulate reinforcing particles can range from about 0.5 nm to about 100 $\mu$m, preferably about 0.5 to 25 $\mu$m. Whiskers can be about 0.5 to 3 mm long.

While it is not essential to the operation of the processes of the present invention, it is advantageous from the standpoint of composite properties and characteristics to use at least about 10% by volume of reinforcing particles, based upon total matrix and reinforcing particles, in the manufacture of composites by the processes of the present invention. It is important to note that, while in most instances, a single type of reinforcing particle will be used in the amount stated in composites made by the processes of the present invention, it may be advantageous to employ more than one type of reinforcing particle.

In one aspect of the invention, the reinforcing particles are coated with a metal matrix material by means of chemical vapor deposition using a suitable metal-containing compound, then consolidated to form a reinforced metal article. Chemical vapor deposition (CVD) is a well known technique for obtaining coatings of various metals and compounds. In general, the transition metals of Groups IVB through VIII, excluding those of Group IB, of the periodic table form decomposable metal carbonyls and may be used, under proper conditions, to provide metal coatings. Other metal compounds which may be used in a CVD process include certain halides and organometallics.

Of particular interest are processes for coating aluminum and titanium and their alloys onto reinforcing particles. For coating each of these metals, several compounds may be used. For example, for CVD of aluminum, triisobutyl aluminum, $(i\text{-}C_4H_9)_3Al$, may be used. Further, Shinzawa, U.S. Pat. No. 5,130,459, issued Jul. 14, 1992, discloses the use of the compound $(CH_3)_3Al\text{-}(CH_3)_2AlH$ for this purpose. CVD of titanium can be accomplished using $TiCl_4$, as disclosed by Sundhu et al, U.S. Pat. No. 5,173,327, issued Dec. 22, 1992, or by using an organic titanium compound having an aliphatic alkoxide or an aliphatic diketone as a ligand, as disclosed by Onishi, U.S. Pat. No. 5,379,718, issued Jan. 10, 1995.

The methods and apparatus for coating by CVD are well known in the art. In general, temperature for reactions used in CVD are in the range of 500° to 1200° C., mostly at the upper end. The use of organometallic reactants tends to lower the deposition temperature. In order to evenly coat the reinforcing particles, it is preferred to use a fluidized bed coater in which the reinforcing particles are maintained in a fluidized state, coated with the metal reactant and then passed into a heated zone wherein the metal is deposited onto the particles.

In another aspect of the invention, the reinforcing particles are coated with a metal matrix material by means of electrochemical deposition of a metal, followed by consolidation of the metal-coated particles. Electrochemical deposition is a known process. At least three apparatus and methods for coating fine particulate materials using these apparatus are available; the methods and apparatus are disclosed in Takeshima et al, U.S. Pat. No. 4,954,235, issued Sep. 4, 1990, Lashmore et al, U.S. Pat. No. 5,603,815, issued Feb. 18, 1997, and Lashmore et al, U.S. Pat. No. 5,698,081, issued Dec. 16, 1997. These references have in common the feature that the fine particulate materials are maintained in constant motion during the deposition or plating process.

If the fine particulate material is nonconductive, the material is first plated with a thin coating of conductive material, e.g., copper, iron, cobalt, nickel and the like, through the use of electroless (autocatalytic) plating. The electroless bath includes an aqueous solution containing metal ions, one or more chemical reducing agents, a catalyst, one or more complexing agents and one or more bath stabilizers. The metal ions are autocatalytically or chemically reduced by the reducing agent or agents, which causes the metal to be deposited onto the fine particulate material.

Of particular interest are processes for electroplating aluminum and titanium and their alloys onto reinforcing particles. Aluminum and its alloys can be electrodeposited from mixtures of $AlCl_3$, NaCl and, if an electrodeposited alloy is desired, the chloride salt of the solute metal, at temperatures as low as 120° C. In the Al—Ti system, the melt chemistry is complicated by the possible presence of titanium in the 2, 3 and 4 oxidation states. In addition, titanium has poor solubility as the chloride salt and must form a tetrachloroaluminate complex. The preferred titanium electroactive species is $Ti^{+2}$.

Several techniques for electroplating titanium are known, including using a strongly alkaline solution of titanic oxide or titanic hydroxide, organic salts of tetravalent titanium, and molten salts of titanium.

The metal-coated reinforcing particles are consolidated to form a reinforced metal article. The metal-coated reinforcing particles can be roll compacted to form a green strip, which is then hot worked by hot rolling to a desired thickness. Alternatively, the metal-coated reinforcing particles can be molded into a near net-shape article by, for example, vacuum hot pressing or Hot Isostatic Pressing (HIP). The HIP process is well known in the art and has been practiced within a relatively broad temperature range, for example, about 450° to 600° C. for aluminum and its alloys, and about 700° to 1200° C. for titanium and its alloys, and within a relatively broad pressure range, for example, 1 to 30 KSI, generally about 15 ksi. Other methods of working the metal-coated reinforcing particles include hot forging, cold isostatic pressing and hot forging, or cold isostatic pressing and hot extrusion. These methods are likewise well known in the art.

In the consolidated state, the reinforcing particles are closely packed together. If it is assumed that these particles are spherical in shape, the closest possible packing of particles leaves a void space of about 26 per cent of total volume. This void space must be filled with the matrix metal. Thus, the reinforcing particles must be coated with sufficient metal to provide for filling of this void space. In general, coating the particles with sufficient metal to achieve an increase in average particle diameter of at least about 8 percent will provide satisfactory results. A desired coating thickness can be achieved by recycling metal-coated reinforcing particles through the coating step.

It is also within the scope of the invention to blend reinforcing particles coated with a metal matrix material by one of the aforesaid methods, with metal or alloy particles not containing such reinforcement, then consolidate the resulting mixture. The metal or alloy particles not containing reinforcement can be any metal or alloy. This method can be used to achieve a higher final metal volume fraction in the resulting metal matrix composite. This method also allows wide control over the composition of the resulting metal matrix composite.

Various modifications may be made in the present invention without departing from the scope of the appended claims.

I claim:

1. A process for the production of a metal matrix composite consisting of discontinuous reinforcing particles in a metal matrix consisting essentially of aluminum, titanium or an alloy of titanium and aluminum, which comprises the sequential steps of (a) coating said reinforcing particles with at least one metal selected from the group consisting of aluminum and titanium by chemical vapor deposition to a thickness sufficient to fill the void space between said particles; and (b) consolidating the metal-coated particles to provide a reinforced metal article, wherein said reinforcing particles are selected from the group consisting of particulates of carbon, graphite, silicon carbide, aluminum oxide, zirconia, garnet, aluminum silicates including silicates modified with fluoride and hydroxide ions, boron carbide, simple or mixed carbides, borides, carboborides and carbonitrides of tantalum, tungsten, zirconium, hafnium and titanium, and intermetallics.

2. A process for the production of a metal matrix composite consisting of discontinuous reinforcing particles in a metal matrix consisting essentially of aluminum, titanium or an alloy of titanium and aluminum, which comprises the sequential steps of (a) coating said reinforcing particles with at least one metal selected from the group consisting of aluminum and titanium by electrochemical deposition to a thickness sufficient to fill the void space between said particles; and (b) consolidating the metal-coated particles to provide a reinforced metal article, wherein said reinforcing particles are selected from the group consisting of particulates of carbon, graphite, silicon carbide, aluminum oxide, zirconia, garnet, aluminum silicates including silicates modified with fluoride and hydroxide ions, boron carbide, simple or mixed carbides, borides, carboborides and carbonitrides of tantalum, tungsten, zirconium, hafnium and titanium, and intermetallics.

3. A process for the production of a metal matrix composite consisting of discontinuous reinforcing particles in a metal matrix which comprises the sequential steps of (a) coating said reinforcing particles with at least one metal selected from the group consisting of aluminum and titanium by chemical vapor deposition to a thickness sufficient to fill the void space between said particles; (b) blending the resulting coated reinforcing particles with metal or alloy powder, and (c) consolidating the resulting blend to provide a reinforced metal article, wherein said reinforcing particles are selected from the group consisting of particulates of carbon, graphite, silicon carbide, aluminum oxide, zirconia, garnet, aluminum silicates including silicates modified with fluoride and hydroxide ions, boron carbide, simple or mixed carbides, borides, carboborides and carbonitrides of tantalum, tungsten, zirconium, hafnium and titanium, and intermetallics.

4. A process for the production of a metal matrix composite consisting of discontinuous reinforcing particles in a metal matrix which comprises the sequential steps of (a) coating said reinforcing particles with at least one metal selected from the group consisting of aluminum and titanium by electrochemical deposition to a thickness sufficient to fill the void space between said particles; (b) blending the resulting coated reinforcing particles with metal or alloy powder, and (c) consolidating the resulting blend to provide a reinforced metal article, wherein said reinforcing particles are selected from the group consisting of particulates of carbon, graphite, silicon carbide, aluminum oxide, zirconia, garnet, aluminum silicates including silicates modified with fluoride and hydroxide ions, boron carbide, simple or mixed carbides, borides, carboborides and carbonitrides of tantalum, tungsten, zirconium, hafnium and titanium, and intermetallics.

5. The process of claim 1 wherein the size of said reinforcing particles ranges from about 0.5 nm to about 100 $\mu$m.

6. The process of claim 5 wherein the size of said reinforcing particles ranges from about 0.5 to 25 $\mu$m.

7. The process of claim 2 wherein the size of said reinforcing particles ranges from about 0.5 nm to about 100 $\mu$m.

8. The process of claim 7 wherein the size of said reinforcing particles ranges from about 0.5 to 25 $\mu$m.

9. The process of claim 3 wherein the size of said reinforcing particles ranges from about 0.5 nm to about 100 $\mu$m.

10. The process of claim 9 wherein the size of said reinforcing particles ranges from about 0.5 to 25 $\mu$m.

11. The process of claim 4 wherein the size of said reinforcing particles ranges from about 0.5 nm to about 100 $\mu$m.

12. The process of claim 11 wherein the size of said reinforcing particles ranges from about 0.5 to 25 $\mu$m.

* * * * *